US009207028B1

(12) United States Patent
Mock et al.

(10) Patent No.: US 9,207,028 B1
(45) Date of Patent: Dec. 8, 2015

(54) AMMUNITION MAGAZINE

(71) Applicants: Jarret Christian Mock, Fort Myers, FL (US); George Roland Mock, Fort Myers, FL (US)

(72) Inventors: Jarret Christian Mock, Fort Myers, FL (US); George Roland Mock, Fort Myers, FL (US)

( * ) Notice: Subject to any disclaimer, the term of this patent is extended or adjusted under 35 U.S.C. 154(b) by 0 days.

(21) Appl. No.: 14/711,996

(22) Filed: May 14, 2015

Related U.S. Application Data

(63) Continuation of application No. 14/481,412, filed on Sep. 9, 2014, now Pat. No. 9,062,924.

(51) Int. Cl.
*F41A 9/65* (2006.01)

(52) U.S. Cl.
CPC ..... *F41A 9/65* (2013.01)

(58) Field of Classification Search
CPC ..... F41A 9/65
See application file for complete search history.

(56) References Cited

U.S. PATENT DOCUMENTS

| | | | | |
|---|---|---|---|---|
| 2,777,235 | A | 1/1957 | Hopkins | |
| 3,087,270 | A | 4/1963 | Stoner | |
| 3,577,860 | A | 5/1971 | Jestrabek | |
| 4,127,954 | A | 12/1978 | Hausmann | |
| 4,366,638 | A | 1/1983 | Ketterer et al. | |
| 4,509,283 | A | 4/1985 | Chesnet | |
| 4,580,364 | A | 4/1986 | Vyprachticky | |
| 4,765,081 | A | 8/1988 | Dieringer | |
| 4,879,828 | A | 11/1989 | Dieringer et al. | |
| 4,888,899 | A | 12/1989 | Chesnut et al. | |
| 5,099,595 | A | 3/1992 | Chesnut et al. | |
| 2011/0167694 | A1 | 7/2011 | Bigley et al. | |
| 2013/0206787 | A1 * | 8/2013 | Shiell | F42B 39/002 221/279 |

* cited by examiner

*Primary Examiner* — Reginald Tillman, Jr.

(74) *Attorney, Agent, or Firm* — George F. Wallace

(57) ABSTRACT

An ammunition magazine provides one or more rounds to a firearm, and can include a housing defining an ammunition cavity and an ammunition aperture, a follower disposed within the ammunition cavity, a first constant force extension spring, and a second spring. A follower can include a follower wall defining at least one extension spring cavity, within which the first constant force extension spring is disposed. The second spring is disposed between the follower and a bottom housing wall. The first constant force extension spring and second spring bias the follower towards an upper part of the housing to facilitate ejection of rounds via the ammunition aperture.

6 Claims, 5 Drawing Sheets

AMMUNITION MAGAZINE

RELATED DOCUMENTS

This document is related to, incorporates by reference in its entirety, and claims the priority benefit of co-pending U.S. patent application Ser. No. 14/481,412, entitled "Ammunition Magazine," and filed on Sep. 9, 2014 by Janet Christian Mock, et al., which in turn, is related to, incorporated by reference in its entirety, and claimed the priority benefit of U.S. Provisional Patent Application Ser. No. 61/875,406, entitled "Ammunition Magazine," and filed on Sep. 9, 2013 by Jarret Christian Mock, et al.

FIELD OF THE INVENTION

The present invention relates to firearms, and more specifically, to magazines for use with firearms.

BACKGROUND OF THE INVENTION

A magazine is a device used to provide rounds of ammunition to a firearm.

SUMMARY OF THE INVENTION

It is an object of the present invention to provide an ammunition magazine.

In an exemplary embodiment of the present invention, an ammunition magazine for providing one or more rounds to a firearm, can include a rigid housing, a rigid follower, a first constant force extension spring, and a second spring.

In an exemplary aspect of the present invention, a housing can include a bottom housing wall and front, rear, first side, and second side housing walls. The front, rear, first side, and second side housing walls define an ammunition cavity therebetween and an ammunition aperture at an upper part of the housing, with the ammunition aperture having an aperture size sufficient for each of the one or more rounds to pass therethrough.

In another exemplary aspect of the present invention, a follower can be disposed within the ammunition cavity, and can include a main body having an upwardly facing alignment structure and at least one follower wall that defines, at least in part, at least one extension spring cavity.

In a further exemplary aspect of the present invention, a first constant force extension spring can be disposed within the at least one extension spring cavity, and can have a first spring active end fixed to an upper portion of the housing. Further, the first constant force extension spring can be oriented to unroll along one of the front housing wall and the rear housing wall.

In yet another exemplary aspect of the present invention, a second spring can be disposed between the follower and the bottom housing wall.

In still another exemplary aspect of the present invention, the first constant force extension spring and the second spring bias the follower towards the upper part of the housing, and the second spring is one of a second constant force extension spring and a compression spring.

In another exemplary embodiment of the present invention, the at least one follower wall can further define, at least in part, another extension spring cavity, and the second spring can be another constant force extension spring disposed within the other extension spring cavity. Further, the second spring can include a second spring active end fixed to the upper portion of the housing, and can be oriented to unroll along the other of the front wall and the rear wall.

Any combination of the following additional exemplary optional aspects can be applied to any embodiment of the present invention:

- the at least one follower wall can further define a stabilizer positioned to abut at least one of the front, rear, first side, and second side housing walls;
- the at least one follower includes a catch tab;
- the housing can include at least one feed lip positioned to cover at least a portion of the ammunition aperture;
- the at least one follower wall can include at least one of a linear portion and a curved portion;
- the follower can have a follower width and a follower length greater than the follower width, and the at least one follower wall can be positioned perpendicular to the follower length; and
- the at least one follower wall can separate the at least one extension spring cavity and the other extension spring cavity.

These and other exemplary aspects of the present invention are described herein.

DETAILED DESCRIPTION

It should be noted that this disclosure includes a plurality of embodiments, with a plurality of elements and aspects, and such elements and aspects need not necessarily be interpreted as being conjunctively required by one or more embodiments of the present invention. Rather, all combinations of the one or more elements and/or aspects can enable a separate embodiment of the present invention, which may be claimed with particularity in this or any one or more future filed Non-Provisional Patent Applications. Moreover, any particular materials, structures, and/or sizes disclosed herein, whether expressly or implicity, are to be construed strictly as illustrative and enabling, and not necessarily limiting. Therefore, it is expressly set forth that such materials, structures, and/or sizes independently or in any combination of one of more thereof, are merely illustratively representative of one or more embodiments of the present invention and are not to be construed as necessary in a strict sense.

Further, to the extent the same element or aspect is defined differently within this disclosure, whether expressly or implicitly, the broader definition is to take absolute precedence, with the distinctions encompassed by the narrower definition to be strictly construed as optional.

Illustratively, perceived benefits of the present invention can include functional utility, whether expressly or implicitly stated herein, or apparent herefrom. However, it is expressly set forth that these benefits are not intended as exclusive. Therefore, any explicit, implicit, or apparent benefit from the disclosure herein is expressly deemed as applicable to the present invention.

Figure 1A:
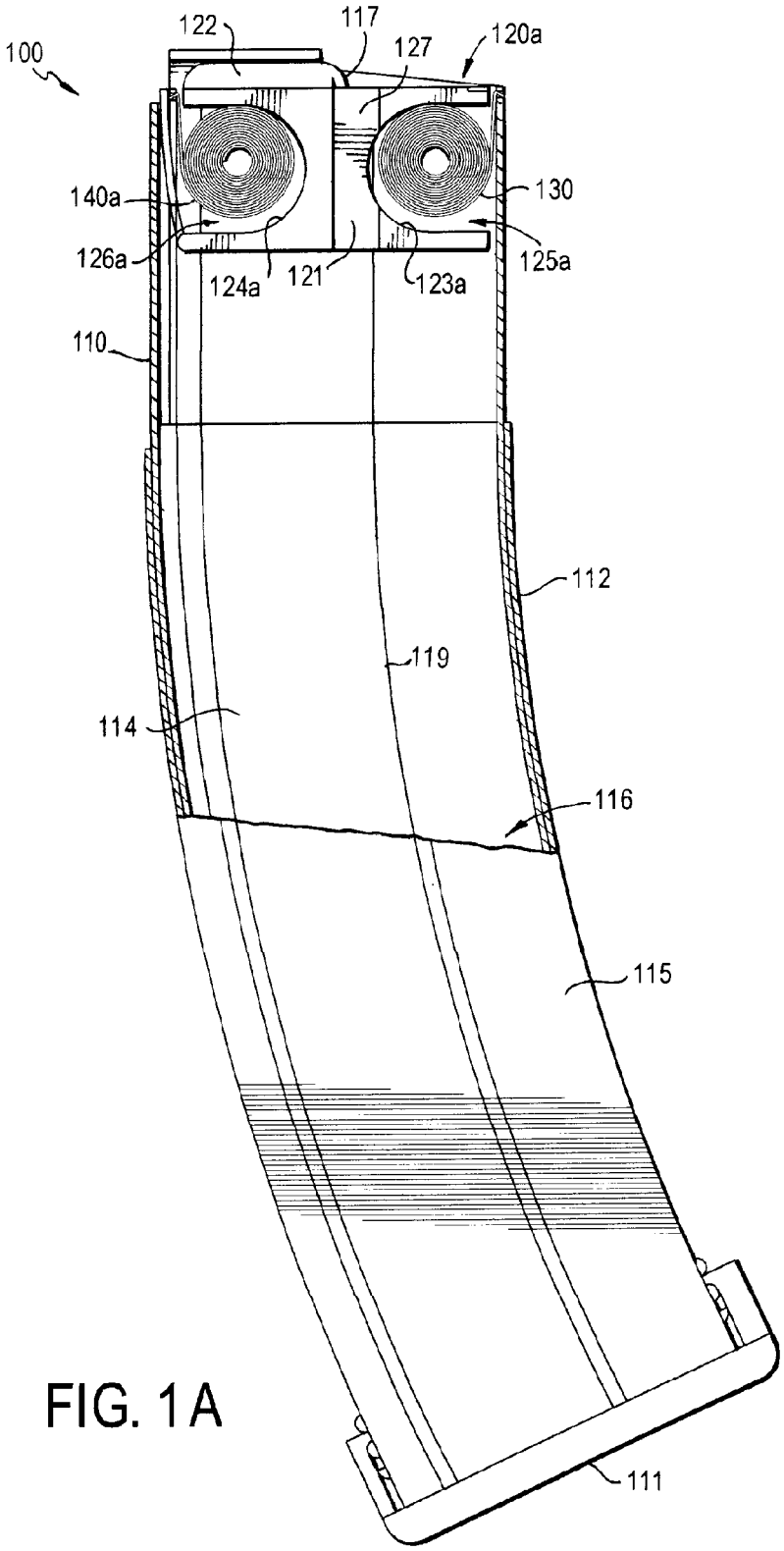
FIG. 1*a* illustrates an exemplary magazine according to the present invention, in which a follower is manipulated via dual constant force extension springs.
Figure 1B:
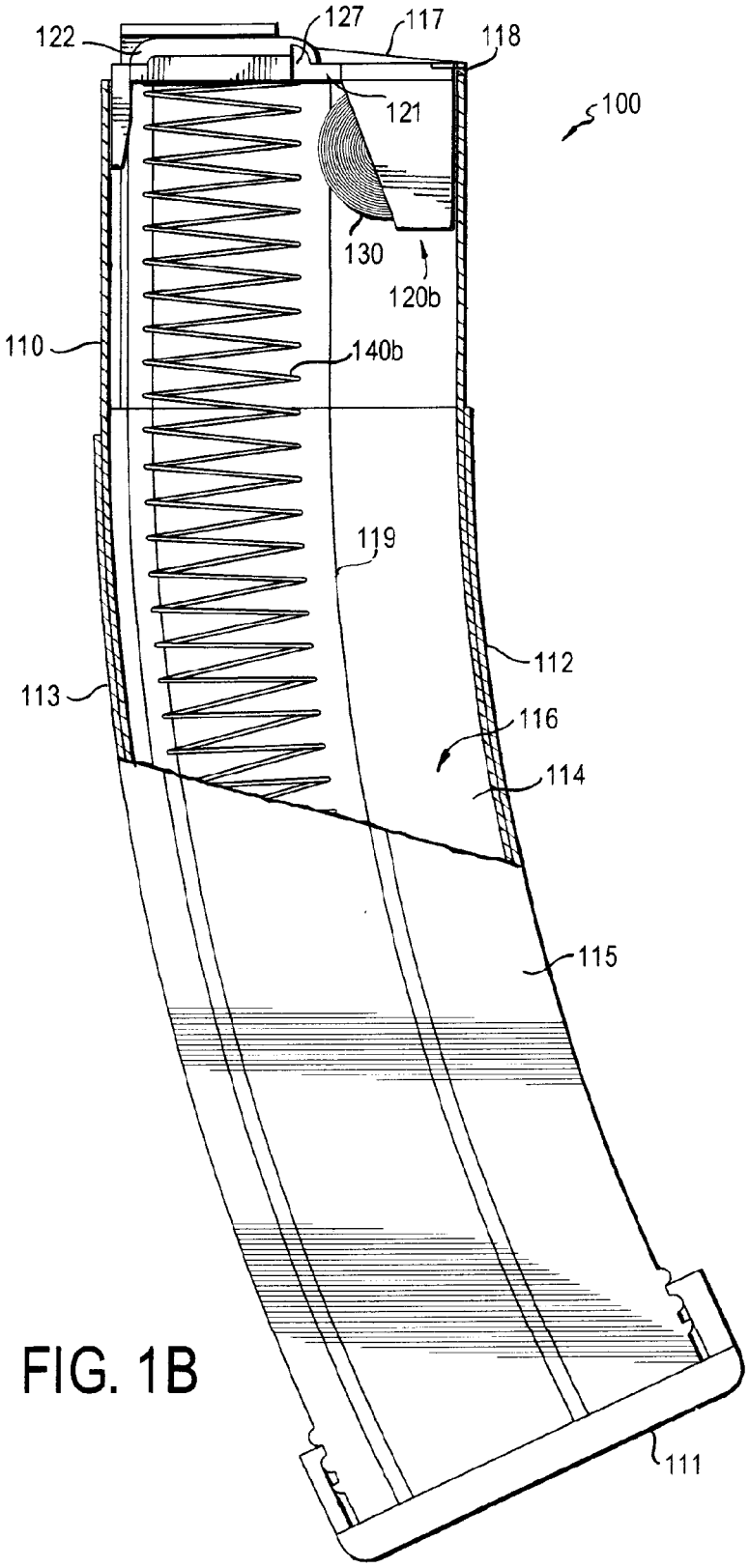
FIG. 1*b* illustrates another exemplary magazine according to the present invention, in which a follower is manipulated via a constant force extension spring and a compression spring.

FIGS. 1*a* and 1*b* illustrate exemplary basic embodiments of the present invention, in which an ammunition magazine 100 can be configured to provide one or more rounds to a firearm (not shown) via a housing 110; a follower 120*a* (as illustrated in FIG. 1*a*) or 120*b* (as illustrated in FIG. 1*b*); a first constant force extension spring 130; and a second spring, which can be one of a second constant force extension spring 140*a* (as illustrated in FIG. 1*a*) and a compression spring 140*b* (as illustrated in FIG. 1*b*). The illustrative embodiment of FIG. 1*a* illustrates first and second constant force extension springs 130, 140*a*; whilst the illustrative embodiment of FIG. 1*b* illustrates first constant force extension spring 130 and compression spring 140*b*.

In an exemplary aspect of the present invention, housing 110 can have a bottom housing wall 111, a front housing wall 112, a rear housing wall 113, a first side housing wall 114, and a second side housing wall 115, which define, an ammunition cavity 116 therebetween, and an ammunition aperture 117, located at an upper part of the housing, and having a size sufficient for one or more rounds to pass therethrough.

Figure 2A:
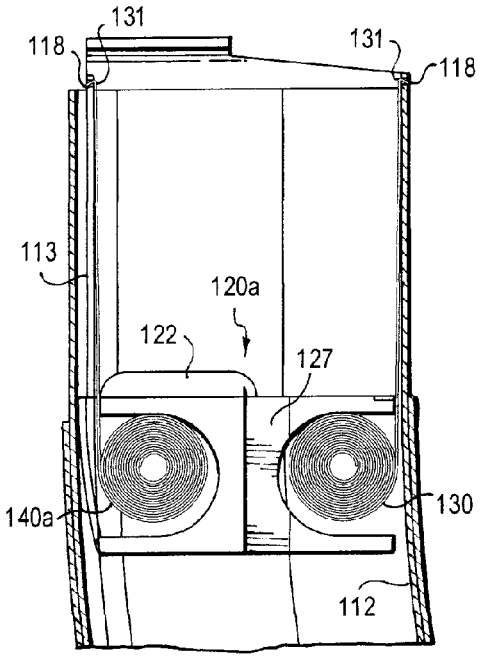
FIG. 2*a* re-illustrates an exemplary magazine according to the present invention, in which a follower is manipulated via dual constant force extension springs.
Figure 2B:
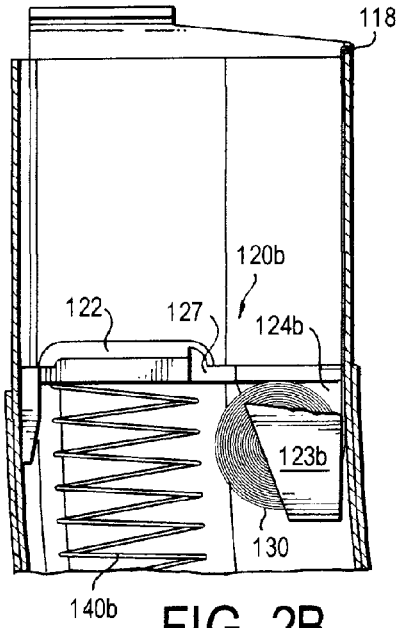
FIG. 2*b* re-illustrates an exemplary magazine according to the present invention, in which a follower is manipulated via a constant force extension spring and a compression spring.
Figure 3A:
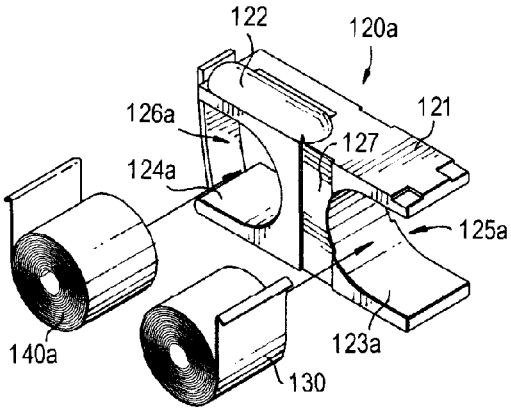
FIG. 3*a* illustrates an exemplary follower configured for manipulation via dual constant force extension springs.
Figure 3B:
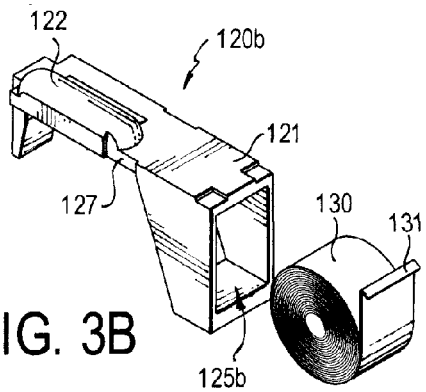
FIG. 3*b* illustrates an exemplary follower configured for manipulation via a constant force extension spring and a compression spring.

As illustrated, followers 120*a*, 120*b* can be disposed within ammunition cavity 116, and can include a main body 121 having an upwardly facing alignment structure 122. As illustrated in FIG. 1*a*, follower 120*a* can be configured to assist in positionally retaining a first constant force extension spring 130 and second constant force extension spring 140*a*. For example, as illustrated in FIGS. 2*a* and 3*a*, follower 120*a* can include first and second follower walls 123*a*, 124*a* that respectively define first and second extension spring cavities 125*a*, 126*a*, in which first and second constant force extension springs 130, 140*a* can be respectively disposed. As illustrated in FIG. 1*b*, follower 120*b* can be configured to assist in positionally retaining first constant force extension spring 130 and a compression spring 140*b*. For example, as illustrated in FIGS. 2*b* and 3*b*, follower 120*b* can include first and second follower walls 123*b*, 124*b* that define an extension spring cavity 125*b*, in which first constant force extension spring 130 can be disposed; and further, main body 121, in cooperation with the bottom housing wall 111 (shown in FIG. 1*b*), can positionally retain compression spring 140*b* by functioning as respective abutments.

As further illustrated in FIGS. 1*a* and 2*a*, first and second constant force extension springs 130, 140*a* can be respectively disposed within first and second extension spring cavities 125*a*, 126*a*, with each spring having an active end 131 fixed to at least one upper portion of housing 110, such as, for example and not in limitation, a housing notch 118, and can be oriented to respectively unroll along front and rear housing walls 112, 113. Accordingly, first and second constant force extension springs 130, 140*a* spring-bias follower 120*a* upwardly, such that as follower 120*a* is moved downwardly when rounds (not shown) are pushed into the magazine via ammunition aperture 117, first and second constant force extension springs 130, 140*a*, unroll along front and rear housing walls 112, 113, and collectively exert forces to pull follower 120*a* upwardly, such that rounds are pushed out of ammunition cavity 116 via ammunition aperture 117.

As further illustrated in FIG. 1*b*-3*b*, first constant force extension spring 130 can be disposed within extension spring cavity 125*b*, and can include an active end 131 fixed to an upper portion of housing 110, such as, for example and not in limitation, a notch 118, and can be oriented to respectively unroll along front or rear housing wall 112, 113. Notably, such fixation of active end 131, with any embodiment of the present invention, can be effectuated in any apparent manner desired, including but not limited to, providing a fold or one or more notches at active end 131, which can accordingly be positioned over or otherwise engaged with any portion of housing 110. Further, compression spring 140*b* can be disposed between main body 121 and bottom housing wall 111. Accordingly, first constant force extension spring 130 and compression spring 140*b* spring-bias follower 120*b* upwardly, such that as follower 120*b* is moved downwardly when rounds (not shown) are pushed into magazine 100 via ammunition aperture 117, first constant force extension spring 130 unrolls along front or rear housing wall 112, 113 and compression spring 140*b* compresses between main body 121 and bottom housing wall 111, and collectively exert forces to respectively pull and push follower 120*b* upwardly, such that rounds can exit ammunition cavity 116 via the ammunition aperture 117.

Figure 3C:
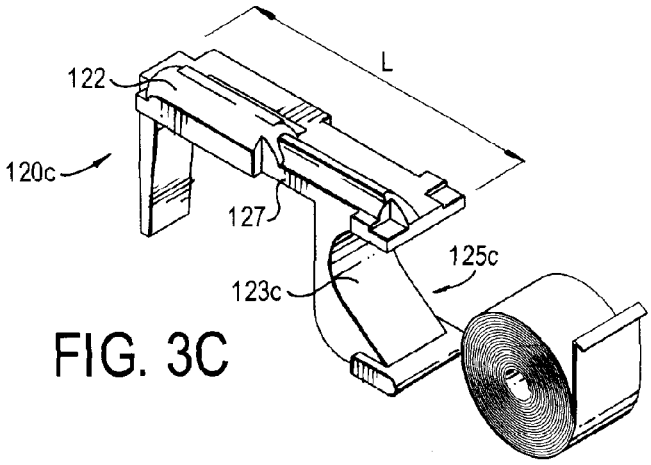
FIG. 3*c* illustrates another exemplary follower having a follower wall positioned perpendicular to a length of the follower.
Figure 3D:
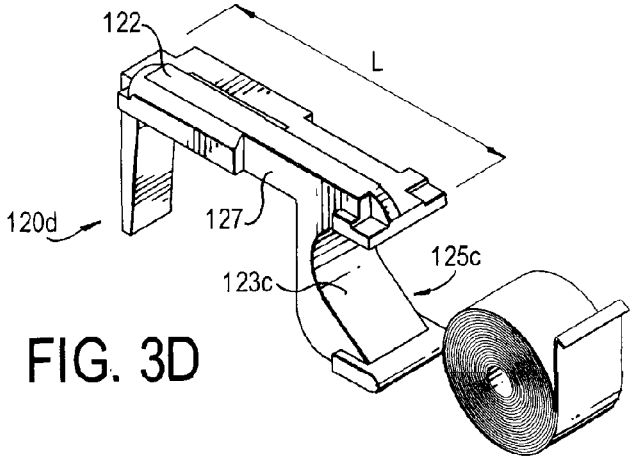
FIG. 3*d* illustrates another exemplary follower having a follower wall positioned perpendicular to a length of the follower, and with an alignment structure with an at least substantially flat upper portion.

FIGS. 3*c* and 3*d* illustrate alternative embodiments of a follower 120*c*, 120*d*. As illustrated, a follower 120*c*, 120*d* can include a follower wall 123*c* that can be positioned perpendicular to a length L of the follower 120*c*, 120*d*. Accordingly, follower wall 123*c* can be positioned between, and therefore separate, extension spring cavity 125*c*, to prevent adjacent springs from physically interfering with each other during operation of the present invention. As further illustrated, alignment structure 122 can be provided with an upper portion that is rounded (FIG. 3*c*) or at least substantially flat (FIG. 3*d*).

In an exemplary aspect of the present invention, housing 110 can be formed from any one or more materials that provide sufficient rigidity and strength to accommodate anticipated stresses and forces arising from functionality of magazine 100 as described herein. For example, and not in limitation, housing 110 can be formed from stamped or machined metal, such as aluminum or steel; or can be formed or molded from a rubber or plastic, such as a glass filled polymer, LEXAN®, or acrylonitrile butadiene styrene ("ABS"), for example and not in limitation.

In another exemplary aspect, housing 110 can be provided with any shape or size that is functionally consistent with the present invention as described, and can be dictated at least in part by the number, size, stacking orientation (if so desired), and shape of the intended ammunition rounds. For example, as illustrated in FIG. 1*a*, at least a portion of housing 110 can have a parallelepiped shape; with or without one or more slight deviations arising from a curved magazine 100. Further, housing 110 can be straight, or at least partially curved to accommodate the housing of a larger numbers of rounds, such as more than 20 rounds, for example and not in limitation. Further, ammunition cavity 116 can be provided with any desired shape or size that is functionally consistent with the present invention, which can be dictated by the number, size, stacking orientation (if so desired), and shape of the intended rounds to be stored within ammunition cavity 116. For example and not in limitation, at least a portion of ammunition cavity 116 can have a parallelepiped shape; with or without one or more slight deviations arising from a curved magazine 100. Moreover, for improved grip and/or appearance, housing 110 can be provided with a smooth or textured exterior surface, and/or can be ornamentally designed or badged with a symbol, design, and/or trademark.

As illustrated in FIGS. 1*a* and 1*b*, housing 110 can optionally include at least one internal guide 119, which can be integral with the housing or fixed thereto; and as illustrated in FIGS. 3*a*-3*d*, follower 120*a*-*d* can optionally include at least one follower notch 127, such that guide 119 and follower notch 127 cooperatively guide movement of the follower and/or the one or more rounds with a desired alignment. Notably, however, guide 119 and notch 127 can be swapped to the extent desired, in that a follower notch 127 can be provided with housing 110 and guide 119 provided with a follower. In yet a further exemplary aspect of the present invention, guide 119 can be provided with a width complementarily sized with notch 127, so as to more closely define the movement and/or orientation of any follower.

Figure 4:
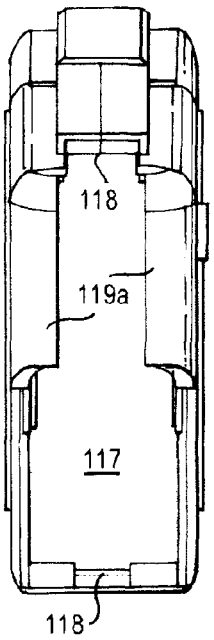
FIG. 4 illustrates a top-view of magazine according to the present invention.

FIG. 4 illustrates a further exemplary aspect of the present invention, in which housing 110 can optionally include at least one feed lip 119*a*, which can be integral with the housing or fixed thereto. In one exemplary embodiment, feed lip 119*a* can be positioned to cover at least a portion of ammunition aperture 117, and can be curved inwardly as illustrated in FIG. 4. Accordingly, by functioning as an abutment, feed lip 119*a* can prevent rounds within ammunition cavity 116 from untimely exiting, or being ejected, therefrom. Further, feed lip 119*a* can assist in maintaining an ejected round in a parallel orientation relative to any follower, such that proper loading via magazine 100 into a firearm can be effectuated.

Referring to FIGS. 1*a* and 1*b*, in yet another exemplary aspect of the present invention, bottom housing wall 111 can optionally be detachable from and re-attachable to housing 110. For example and not in limitation, such detaching and re-attaching can be effectuated by any functionally compatible means, such as one or more clips, slots, tabs, threads, screws, etc. Notably, however, bottom housing wall 111 is to be construed as an optional aspect of housing 110 with respect to any embodiment lacking compression spring 140*b*, or one having a compression spring but with an optional compression spring base within housing 110 to effectuate positional retention and operation of the compression spring as described herein.

In still yet another exemplary aspect of the present invention, when respectively within housing 110, any of followers 120*a*-120*d* can be configured to lower or rise within ammunition cavity 116, as ammunition rounds are loaded into, and leave, the ammunition cavity via ammunition aperture 117. In still another exemplary aspect of the present invention, a follower 120*a*-120*d* can be formed, from any one or more materials, and with any desired thickness, that provide sufficient rigidity to function as described herein. For example and not in limitation, a follower can be formed from any type of metal, plastic, rubber, and/or any man-made or naturally occurring material, including variations thereof.

As noted above, a follower 120*a*-120*d* can include a main body 121 having an upwardly facing alignment structure 122. In a further exemplary aspect of the present invention, in operation, such a follower "follows" a stack of ammunition rounds and acts as an abutment that pushes or ejects rounds out of ammunition cavity 116 as they are consumed by a firearm. In yet another exemplary aspect, a follower can be complementarily shaped with ammunition cavity 116 so as to freely move upwardly and downwardly within the cavity, while being maintained in a lateral position that is at least generally perpendicular to at least one of front, rear, first, and second housing walls 112-115, as illustrated in FIGS. 1*a* and 1*b*, for example and not in limitation. For example and not in limitation, a follower 120*a*-120*d* can be generally provided with a rectangular shape.

Figure 5:
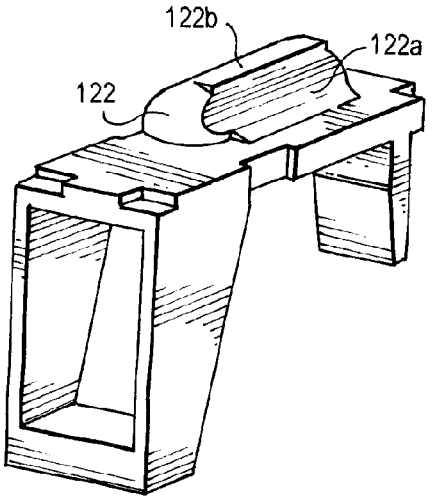
FIG. 5 illustrates an exemplary follower according to the present invention with an optional concave portion 122*a* and an upper portion 122*b* that is optionally rounded.

Referring now to FIG. 5, in yet a further exemplary aspect of the present invention, alignment structure 122 of any follower disclosed herein can provide a spacing function so as to facilitate self-stacking of ammunition rounds within ammunition cavity 116 as such rounds are loaded into magazine 100, and optionally, can include a concave portion 122*a* to snuggly engage and assist in positioning an initial round inserted into ammunition cavity 116; and/or an upper portion 122*b*, which can be rounded (or at least substantially flat), for example and not in limitation, so as to strategically position a second round between an initial round and one of the first and second side housing walls 114,115, which can facilitate the stacking of rounds.

In yet another exemplary aspect of the present invention, when positioned within ammunition cavity 116, at least one portion of main body 121 can be configured to be perpendicular to one or more of front, rear, first side, and second side housing walls 112-115 such that it can abut such a wall to maintain the follower in an orientation perpendicular to such a wall. Notably, such a portion can be provided by any one or more follower wall 123*a*,124*a*,123*b*,124*b*, and/or any portion of a follower 120*a*,120*b*, including but not limited to a catch tab (described infra).

Figure 6A:
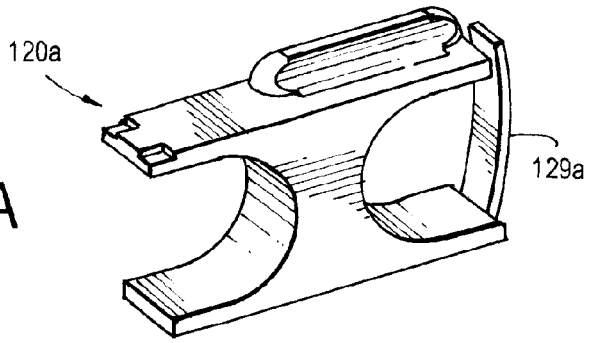
FIG. 6*a* illustrates an exemplary follower having an exemplary catch tab.
Figure 6B:
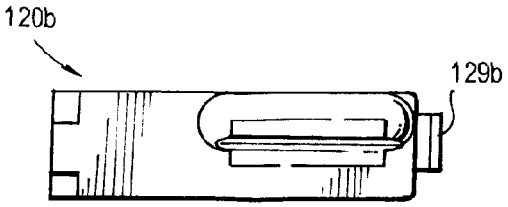
FIG. 6*b* illustrates another exemplary follower having another exemplary catch tab.

As illustrated in FIGS. 6*a* and 6*b*, in still another exemplary aspect of the present invention, a follower 120*a*-120*d* can optionally include a catch tab 129*a*,129*b* for engaging a bolt catch mechanism (not shown) of a firearm. A bolt catch mechanism (not shown) can lock a firearm bolt in an open position once the last round from a magazine has been fired, with such locking allowing for a quicker insertion of a new magazine. As illustrated in FIG. 6*a*, catch tab 129*a* can extend upwardly from a lower portion of follower 120*a*; and as illustrated in FIG. 6*b*, which is a top-view perspective, catch tab 129*b* can alternatively extend in any desired direction from an upper area of follower 120*b*. Notably, any follower 120*a*-120*d* can utilize either type of catch tab 129*a*,129*b*, and further, any type of catch tab can emanate from any portion of any type of follower.

It will be apparent to one of ordinary skill in the art that the manner of making and using the claimed invention has been adequately disclosed in the above-written description of the exemplary embodiments and aspects.

It should be understood, however, that the invention is not necessarily limited to the specific embodiments, aspects, arrangement, and components shown and described above, but may be susceptible to numerous variations within the scope of the invention.

Therefore, the specification and drawings are to be regarded in an illustrative and enabling, rather than a restrictive, sense.

Accordingly, it will be understood that the above description of the embodiments of the present invention are susceptible to various modifications, changes, and adaptations, and the same are intended to be comprehended within the meaning and range of equivalents of the appended claims.

We claim:

1. An ammunition magazine for providing one or more rounds to a firearm, said magazine comprising:

a rigid housing having a bottom housing wall and front, rear, first side, and second side housing walls defining both an ammunition cavity therebetween and an ammunition aperture at an upper part of said housing, the ammunition aperture having an aperture size sufficient for each of the one or more rounds to pass therethrough;

a rigid follower, disposed within the ammunition cavity, and including a main body having an upwardly facing alignment structure and at least one follower abutment defining at least in part first and second extension spring cavities;

a first constant force extension spring, disposed within the first extension spring cavity, and having a first spring active end fixed to an upper portion of said housing, said first constant force extension spring being oriented to unroll along one of the front housing wall and the rear housing wall; and a second constant force extension spring, disposed within the second extension spring cavity, and having a second spring active end fixed to another upper portion of said housing, said second constant force extension spring being oriented to unroll along the other of the front housing wall and the rear housing wall;

wherein said first and second constant force extension springs bias said follower towards the upper part, and the at least one follower abutment separates the first and second extension spring cavities.

2. The magazine of claim 1, wherein the at least one follower abutment further defines a stabilizer positioned to abut at least one of the front, rear, first side, and second side housing walls.

3. The magazine of claim 1, wherein said follower includes a catch tab.

4. The magazine of claim 1, wherein said housing includes at least one feed lip positioned to cover at least a portion of the ammunition aperture.

5. The magazine of claim 1, wherein the at least one follower abutment includes at least one of a linear portion and a curved portion.

6. The magazine of claim 1, wherein said follower has a follower width and a follower length greater than the follower width, and the at least one follower abutment is positioned perpendicular to the follower length.

* * * * *